United States Patent [19]

Hartman

[11] Patent Number: 4,998,724

[45] Date of Patent: Mar. 12, 1991

[54] THUMB WRESTLING GAME APPARATUS WITH STABILIZING HANDLE

[76] Inventor: Richard B. Hartman, 7516 201st SE., Issaquah, Wash. 98027

[21] Appl. No.: 565,792

[22] Filed: Aug. 10, 1990

[51] Int. Cl.[5] ..... A63B 71/04
[52] U.S. Cl. ..... 273/1 GI
[58] Field of Search ..... 273/1 GI

[56] References Cited

U.S. PATENT DOCUMENTS 3,790,165 2/1974 Schmidt et al. ..... 273/1 GI

OTHER PUBLICATIONS

The Washington Post Magazine, 8-5-1984, p. 47, Rules of Thumb for Gladiators.

*Primary Examiner*—Paul E. Shapiro

[57] ABSTRACT

Improved apparatus for playing a game of thumb wrestling includes a stabilizing handle which employs forces generated by firmly interlocking fingers of players' hands to stabilize and anchor a game ring surface. Game ring surface includes holes through which the thumbs of opponents are inserted upwardly, and a solid wrestling region upon which one thumb can forcibly pin another thumb, thereby giving the realistic impression of a pin in wrestling.

5 Claims, 4 Drawing Sheets

THUMB WRESTLING GAME APPARATUS WITH STABILIZING HANDLE

BACKGROUND

1. Field of Invention

This invention relates to a novelty amusement toy, specifically, an improved apparatus for playing a game of thumb wrestling incorporating a stabilizing handle.

2. Discussion of Prior Art

In its simplest form, the game of thumb wrestling has been enjoyed by children and adults for generations. The basic game is played by interlocking the hands of two opponents in such a way that the index, middle, ring and pinky fingers of one player are firmly curled around the corresponding fingers of the opposing player's hand. This leaves each player's thumb unencumbered and creates a naturally stable playing surface comprised of the top edges of the opponents' interlocked index fingers upon which each player attempts to use his or her thumb to trap and hold down the opposing player's thumb for a previously agreed-upon count.

Heretofore, attempts have been made to enhance the enjoyment of the game of thumb wrestling with apparatuses resembling miniature wrestling rings. These apparatuses generally consist of two- or three-dimensional representations of wrestling rings whose game surfaces contain a hole or holes through which opponents insert their thumbs upwardly and beneath which players interlock hands in the manner described above.

These attempts at creating an apparatus for enhancing the enjoyment of thumb wrestling have suffered from a number of disadvantages, a common disadvantage being the inefficient or nonexistent means for stabilizing and anchoring a game ring surface to the players' interlocked hands.

U.S. Pat. No. 3,790,165 to Schmidt and Menke (1974) discloses a complicated apparatus for playing a game of thumb wrestling that surrounds the players' hands as in a cage and requires the time-consuming adjustment of ring surface height to ensure the ring surface remains in close proximity to and does not separate from the players' interlocked hands. This approach requires several interchangeable or adjustable elements, is costly to produce, and causes delays each time players with varying hand sizes take to the ring.

Additionally, the patent cited in the previous paragraph discloses only a single opening in the game ring surface through which both players' thumbs are upwardly inserted. As a result, players do not actually compete to depress each other's thumbs against the wrestling mat, or game surface, itself, but rather must use an imaginary gauging means for determining when a match ends; this diminishes the realistic impression of wrestling since in real wrestling the loser is forcibly pinned against the wrestling ring surface itself.

The problem of realistically representing a pin, or end of match, in wrestling was partially overcome by the 1983 publication of "The Official Book of Thumb Wrestling" (Workman Publishing Company), which incorporated two holes in its game ring surface instead of one. This format created a solid wrestling region between the two thumb holes, allowing one player's thumb to firmly pin an opponent's thumb against the ring surface itself as in real wrestling. However, "The Official Book of Thumb Wrestling" included no means for stabilizing and anchoring the game ring surface to the players' interlocked hands. Rigorous games of thumb wrestling between spirited opponents thus resulted in the book wobbling and in some cases falling off the players' interlocked hands, thereby diminishing enjoyment of the game and or terminating it prematurely.

Neither of the prior art inventions cited above anticipated a structure whereby the force created by the interlocked fingers of the opponents' hands would be exploited as a means for stabilizing and anchoring the game ring surface upon the players' hands.

Therefore it can be seen that there remains a need for a thumb wrestling apparatus incorporating a simplified, efficient means for ensuring the game ring surface remains in close proximity to the opponents' hands; that requires no time-consuming adjustments to accommodate hands of varying sizes; that includes a solid wrestling region located between opposing thumbs so as to more closely represent the action of a pin in real wrestling; and that employs the force created by the interlocked fingers of the opponents' hands to stabilize and anchor the game ring surface upon the players hands.

OBJECTS AND ADVANTAGES

Accordingly, the objects and advantages of my invention are to provide an apparatus for playing a game of thumb wrestling including a stabilizing handle:

(a) that simply and efficiently ensures that the game ring surface remains in close proximity to opponents' hands;

(b) that requires no time-consuming adjustments to accommodate hands of varying sizes;

(c) that includes a solid wrestling region located between opposing thumbs so as to accurately represent the action of a pin in real wrestling; and (d) that exploits the force created by the firmly interlocked fingers of the opponents' hands as an efficient means for anchoring and stabilizing the game ring surface upon the players' hands during competition.

Further objects and advantages of my invention will become apparent from a consideration of the drawings and ensuing description of it.

Reference Numerals in Drawings

Figure 1:
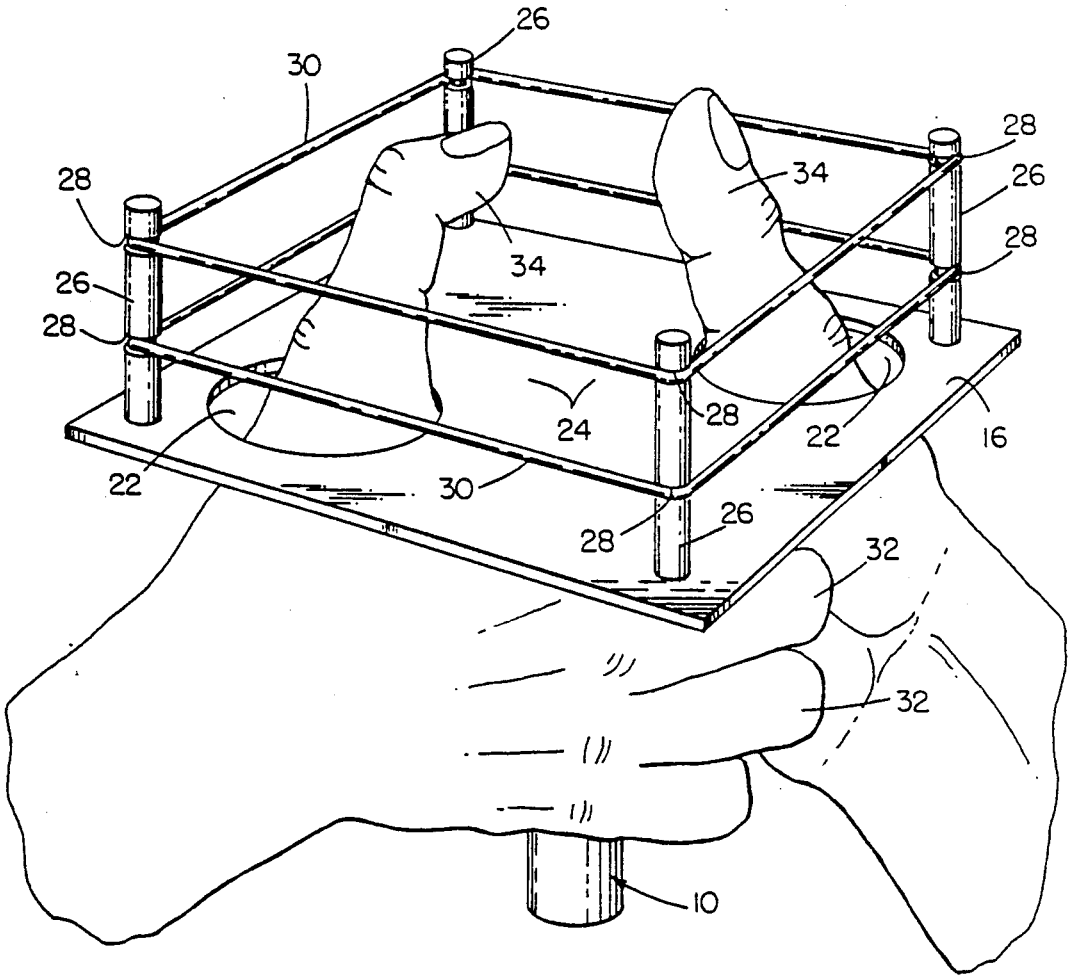
FIG. 1 is a perspective view of a thumb wrestling game apparatus with stabilizing handle, in use, in accordance with the invention.

| | | | |
|---|---|---|---|
| 10 | stabilizing handle | 12 | grip |
| 14 | threaded male tip | 16 | game ring surface |
| 18 | handle mount | 20 | threaded female tip holder |
| 22 | thumb hole | 24 | solid wrestling region |
| 26 | corner post | 28 | notch |

-continued

| Reference Numerals in Drawings | | | |
|---|---|---|---|
| 30 | elastic band | 32 | index,middle,ring,pinky fingers |
| 34 | thumb | | |

DESCRIPTION—FIGS. 1, 2, 4, 5

Figure 2:
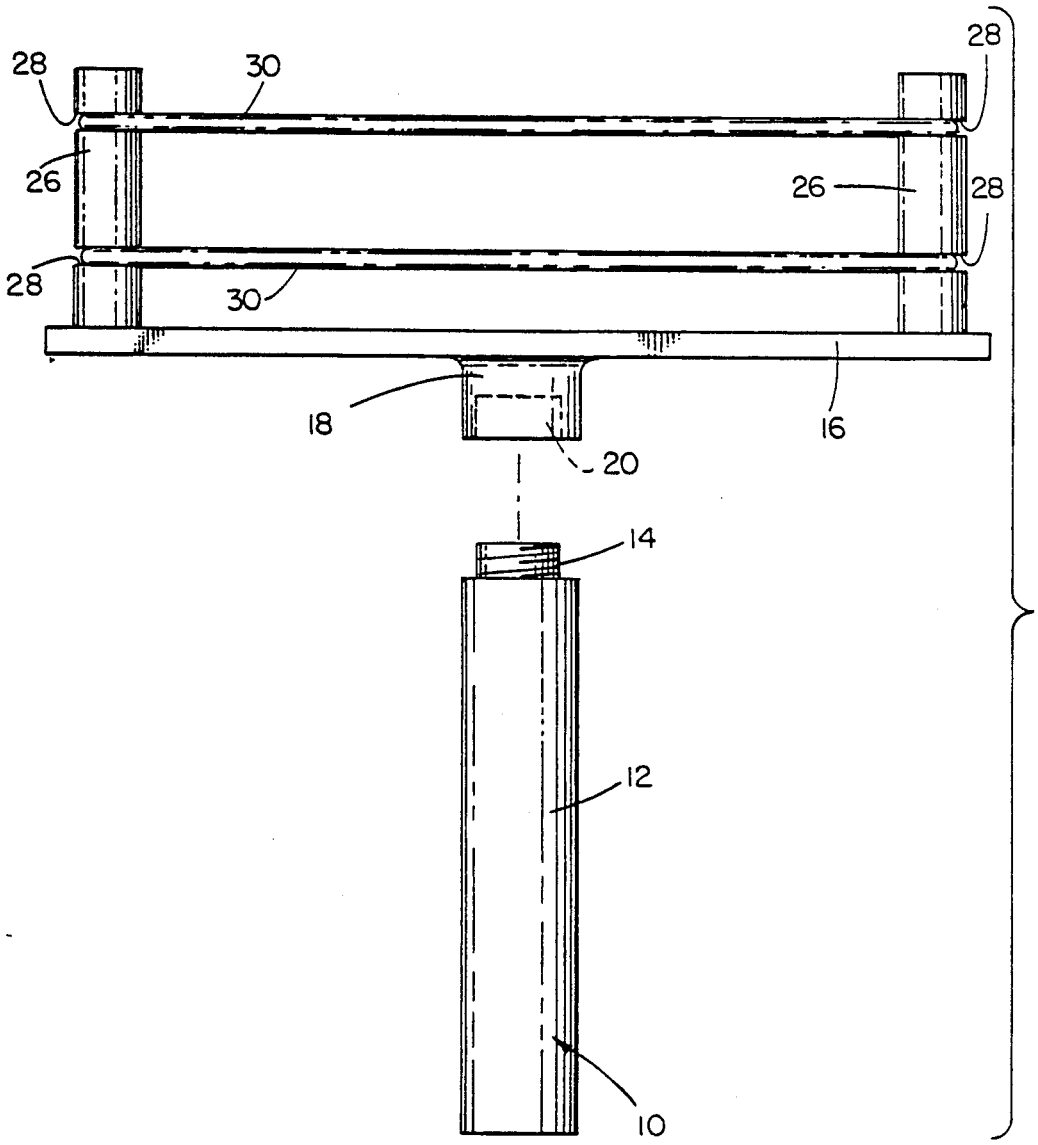
FIG. 2 is an exploded side view of one particular embodiment of the present invention showing a detachable stabilizing handle and structure for fastening handle to bottom of game ring.

FIG. 1 shows a perspective view of the preferred embodiment of my invention in use. FIG. 2 shows an exploded side view of the invention of FIG. 1. A stabilizing handle 10 comprised of a grip 12 and a threaded male tip 14 is fastened to the bottom of game ring surface 16 at handle mount 18. A threaded female tip holder 20 in handle mount 18 receives tip 14. The outside diameter of mount 18 is equal to the diameter of grip 12 so as to create a single columnar structure suitable for grasping by opponents when fully assembled.

In other embodiments of my invention, the stabilizing handle may be fastened to the bottom of the game ring surface by other means, such as by the use of a screw or tack driven through the top of the game ring surface into the stabilizing handle, or by the use of other coupling devices formed by such methods as machining or extrusion. In addition, the stabilizing handle and game ring surface may comprise a solid piece of material created by such means as extrusion.

As seen in FIGS. 1 and 2, game ring surface 16 is also comprised of two thumb holes 22 centered on symmetrical points along a line diagonally bisecting the game ring surface. Thumb holes 22 are separated by a solid wrestling region 24.

Four corner posts 26 at the corners of game ring surface 16 each include two notches 28 for receiving elastic bands 30 which are stretched around posts 26 and held in place parallel to game ring surface 28. Elastic bands 30 may be made from various materials including rubber, fabric-coated rubber and other natural or synthetic materials.

Figure 4:
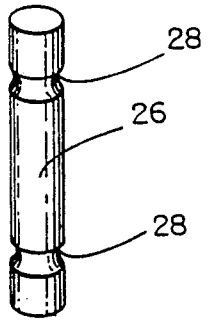
FIG. 4 is a perspective view of a corner post, showing notches for receiving elastic bands.

FIG. 4 shows a perspective view of one corner post 26 with notches 28.

Figure 5:
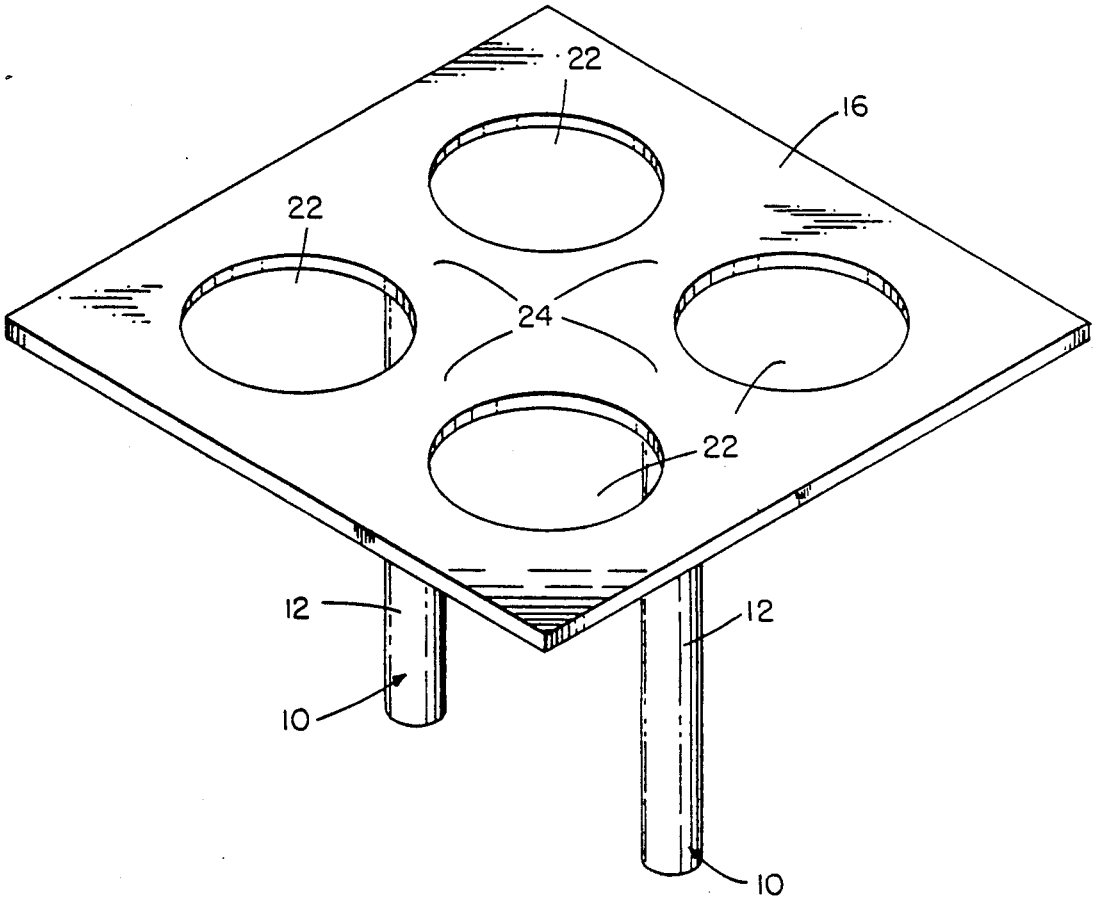
FIG. 5 is a perspective view of another embodiment of my invention containing a two-pronged stabilizing handle and four holes for receiving thumbs.

FIG. 5 shows yet another embodiment of my invention which includes a two-pronged stabilizing handle for accommodating four hands and four thumb holes for receiving four thumbs.

From the description above, a number of advantages of my invention become evident:

(a) A stabilizing handle will stabilize and anchor game ring surface to interlocked hands of opponents.

(b) A stabilizing handle obviates the need for complicated and time-consuming adjustments to the game apparatus to accommodate hands of varying sizes.

(c) Use of more than one thumb hole creates a solid wrestling region between opposing thumbs upon which one thumb can firmly achieve a realistic wrestling pin.

(d) Notched corner posts allow for the rapid removal of elastic bands of one color and replacement with bands of another color, thereby facilitating decoration of game apparatus to suit special occasions or locales.

(e) A stabilizing handle in the manner presently disclosed harnesses the previously unexploited energy created by the firmly interlocked fingers of opposing players' hands to stabilize and anchor game ring surface.

OPERATION—FIGS. 1, 2, 3, 5

If the invention is unassembled as shown in FIG. 2, stabilizing handle 10 is fastened to the bottom of game ring surface 16 by twisting threaded male tip 14 into threaded female tip holder 20 of handle mount 18.

Play is initiated by one player who firmly curls his or her index, middle, ring and pinky fingers 32 around stabilizing handle 10 and inserts thumb 34 upwardly though thumb hole 22. A second player then firmly curls his or her fingers 32 around both stabilizing handle 10 and the first player's curled fingers 32 and inserts thumb 34 upwardly through opposite thumb hole 22.

Figure 3:
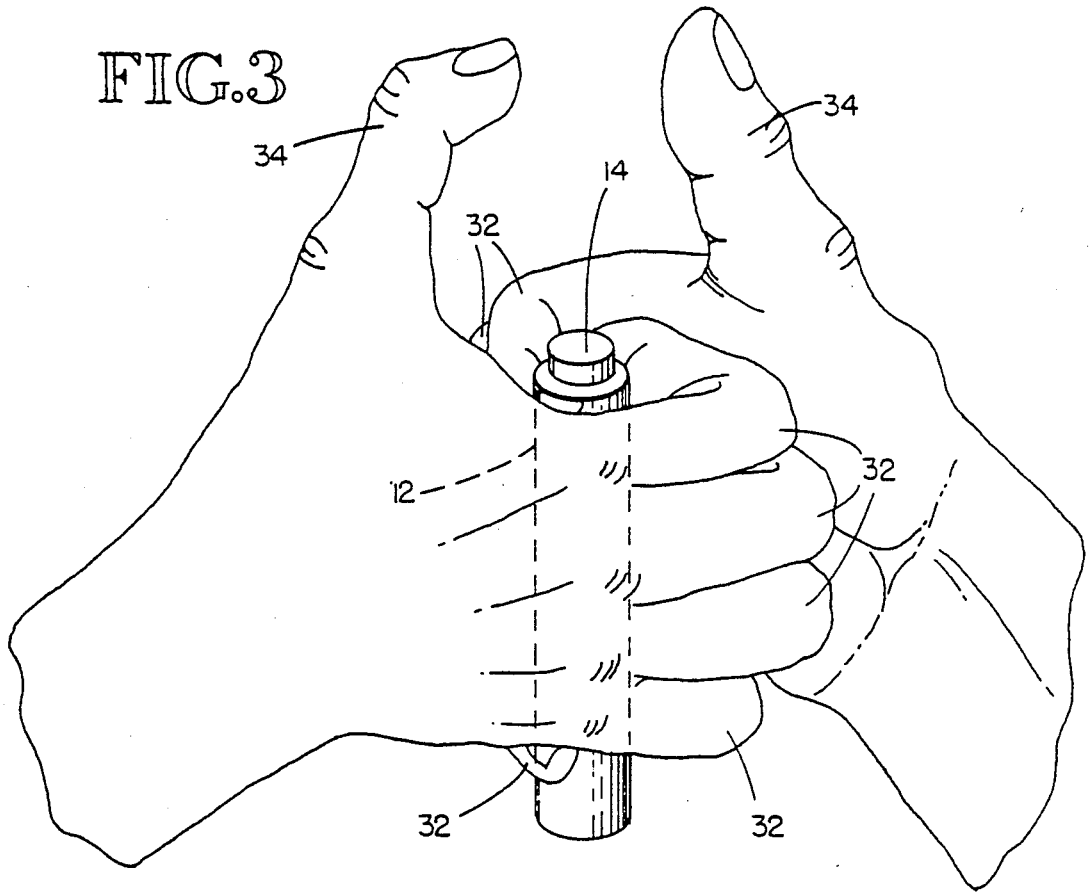
FIG. 3 is a perspective view of stabilizing handle of FIG. 2 before it is fastened to game ring surface, showing how handle is firmly held by players' interlocked hands.

FIG. 3 best shows the manner in which the hands of two players interlock, thereby firmly securing stabilizing handle 10 between curled fingers 32 of each player's hand.

When fully assembled and gripped as shown in FIG. 1, the invention provides for a stable game ring surface 16 which remains anchored to the players' hands throughout competition.

During competition, each player manipulates his or her thumb 34, attempting to trap and hold down the opposing thumb 34 upon solid wrestling region 24 for a previously agreed-upon count. The match ends when a pin in the manner described above is achieved.

Additionally, one embodiment of the present invention permits the interchange of various color elastic bands 30 upon corner posts 26 so as to adapt the visual appearance of the apparatus to fit a particular occasion, such as a holiday, or locale, such as a college. To accomplish this, a previously-installed elastic band 30 is removed by slightly grasping it and stretching it away from corner post 26. This action unseats elastic band 30 from notch 28 and permits removal of the entire elastic band from game apparatus. A different color elastic band 30 may then be installed by stretching it around all four corner posts 26 and seating band 30 in notches 28.

The embodiment shown in FIG. 5 is operated by four hands, which grasp the prongs of stabilizing handle 10 in pairs, insert thumbs upwardly through thumb holes 22 and engage in four-thumb, or tag-team style, competition.

SUMMARY, RAMIFICATIONS AND SCOPE

Accordingly, the reader will see that, when operated, my invention provides for a thumb wrestling apparatus with stabilizing handle that firmly and efficiently stabilizes and anchors the game ring surface upon the players interlocked hands. In doing so, the invention exploits the forces generated by the firmly clasped fingers of the players to ensure that the game ring surface will not wobble or fall off during competition.

Additionally, my invention requires no adjustments to accommodate varying hand sizes, includes a rigid wrestling region upon which a realistic wrestling pin may be simulated, and permits the removal and replacement of various colored elastic bands without necessitating their severing or untying.

Furthermore, the disclosed invention provides for an embodiment which includes a two-pronged stabilizing handle and four thumb holes suitable for play by four opponents competing in team style competition.

Although the description above contains many specificities, these should not be construed as limiting the scope of the invention but as merely providing illustrations of some of the presently preferred embodiments of this invention. For example, the stabilizing handle, shown here as dowel-shaped, can be shaped in the form of a ball, an ovoid or another formation suitable for grasping by the hands of two opponents; corner posts can include more than two notches for receiving elastic bands and notches can be inscribed around the entire circumference of corner posts to simplify installation during manufacture.

Thus the scope of the invention should be determined by the appended claims and their legal equivalents, rather than by the examples given.

I claim:

1. Apparatus for playing a game of thumb wrestling, said apparatus comprising:

(a) a stabilizing handle providing means for gripping said stabilizing handle between interlocking hands of opponents engaged in a game of thumb wrestling;

(b) said stabilizing handle providing means for employing pressure generated by interlocking hands of opponents to stabilize and anchor said stabilizing handle between players' hands;

(c) a game ring surface and means for joining the underside of said game ring surface to said stabilizing handle, wherein said game ring surface is stabilized and anchored upon stabilizing handle throughout competition;

(d) said game ring surface including a plurality of thumb holes for receiving the thumbs of opponents upwardly, wherein remaining fingers of opponents' interlocked hands grip said stabilizing handle below said game ring surface;

(e) said game ring surface including a solid wrestling region between said thumb holes providing resistance means for trapping a thumb of one opponent beneath the thumb of another opponent, wherein said resistance means provides for the accurate representation of the action of a pin in wrestling.

2. Apparatus in accordance with claim 1 wherein each corner of said game ring surface contains a corner post, said corner post including a plurality of notches, said plurality of notches providing means for receiving elastic bands and securing said elastic bands to said corner post when said elastic bands are stretched around other said corner posts on said game ring surface.

3. Apparatus in accordance with claim 2 wherein said elastic bands are variously colored, wherein color scheme of said apparatus can be easily altered by removing elastic bands of one color and installing elastic bands of another color.

4. Apparatus in accordance with claim 1 wherein said stabilizing handle provides means for receiving four hands and wherein said game ring surface provides means for receiving four thumbs so as to accommodate team style thumb wrestling.

5. Improved apparatus for playing a game of thumb wrestling, said apparatus comprising a stabilizing handle providing gripping means for gripping said handle between interlocked hands of opponents, game ring surface and means for anchoring said game ring surface to said stabilizing handle, said game ring surface including a plurality of holes for receiving the thumbs of opponents, said holes being separated by a solid wrestling region upon which one player's thumb can firmly pin an opponent's thumb.

* * * * *